US010871741B2

(12) United States Patent
Sato

(10) Patent No.: US 10,871,741 B2
(45) Date of Patent: Dec. 22, 2020

(54) CLEANING DEVICE AND IMAGE FORMING APPARATUS USING SAME

(71) Applicant: FUJI XEROX CO., LTD., Tokyo (JP)

(72) Inventor: Keiichiro Sato, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 16/556,452

(22) Filed: Aug. 30, 2019

(65) Prior Publication Data

US 2020/0310333 A1 Oct. 1, 2020

(30) Foreign Application Priority Data

Mar. 27, 2019 (JP) ..... 2019-059552

(51) Int. Cl.
*G03G 21/00* (2006.01)
*G03G 15/02* (2006.01)

(52) U.S. Cl.
CPC ..... *G03G 21/0076* (2013.01); *G03G 15/0225* (2013.01)

(58) Field of Classification Search
CPC ..... G03G 21/0076; G03G 21/007; G03G 21/0082; G03G 21/10; G03G 15/0225
See application file for complete search history.

(56) References Cited

U.S. PATENT DOCUMENTS 6,311,038 B1 * 10/2001 Schlueter, Jr. ..... G03G 21/0029 399/350
8,670,685 B2 * 3/2014 Nishida ..... G03G 15/161 399/123

FOREIGN PATENT DOCUMENTS

JP 2002-351279 A 12/2002

* cited by examiner

*Primary Examiner* — Hoang X Ngo
(74) *Attorney, Agent, or Firm* — Sughrue Mion, PLLC

(57) ABSTRACT

A cleaning device that cleans a surface of an image holding unit capable of holding an image formed using an image forming material includes: a cleaning tool that is movable along an intersecting direction intersecting with a moving direction of the image holding unit and cleans the surface of the image holding unit when placed in a contact position where the cleaning tool is in contact with the surface of the image holding unit; and a guiding unit that guides the cleaning tool so that the cleaning tool moves from a non-contact position where the cleaning tool is not in contact with the image holding unit to the contact position for cleaning the surface of the image holding unit, wherein when the image holding unit is moved, the cleaning tool placed in the contact position cleans the surface of the image holding unit.

10 Claims, 12 Drawing Sheets

CLEANING DEVICE AND IMAGE FORMING APPARATUS USING SAME

CROSS-REFERENCE TO RELATED APPLICATIONS

This application is based on and claims priority under 35 USC 119 from Japanese Patent Application No. 2019-059552 filed Mar. 27, 2019.

BACKGROUND

(i) Technical Field

The present disclosure relates to a cleaning device and an image forming apparatus using the same.

(ii) Related Art

As an image forming apparatus of the related art, for example, an apparatus described in JP-A-2002-351279 is already known.

JP-A-2002-351279 (exemplary embodiments and examples of the invention, FIG. 2) discloses an image forming apparatus including a cleaning device that includes a fur brush formed of a conductive fiber member in order to remove a residual toner from a photosensitive drum, includes a recovery roller to which a voltage can be applied with conductivity to be in contact with the fur brush, first captures the residual toner on the photosensitive drum sent to a part of the fur brush by rotational rubbing of the fur brush, guides the residual toner to the recovery roller along with the rotation of the fur brush, and performs electrostatic recovery on the recovery roller by a voltage applied to the recovery roller.

SUMMARY

Aspects of non-limiting embodiments of the present disclosure relate to making an image holding unit less likely to be damaged when a cleaning tool for removing deposits from the surface of the image holding unit moves.

Aspects of certain non-limiting embodiments of the present disclosure address the above advantages and/or other advantages not described above. However, aspects of the non-limiting embodiments are not required to address the advantages described above, and aspects of the non-limiting embodiments of the present disclosure may not address advantages described above.

According to an aspect of the present disclosure, there is provided a cleaning device that cleans a surface of an image holding unit capable of holding an image formed using an image forming material, the device including: a cleaning tool that is movable along an intersecting direction intersecting with a moving direction of the image holding unit and cleans the surface of the image holding unit when placed in a contact position where the cleaning tool is in contact with the surface of the image holding unit; and a guiding unit that guides the cleaning tool so that the cleaning tool moves from a non-contact position where the cleaning tool is not in contact with the image holding unit to the contact position for cleaning the surface of the image holding unit, wherein when the image holding unit is moved, the cleaning tool placed in the contact position cleans the surface of the image holding unit.

BRIEF DESCRIPTION OF THE DRAWINGS

Exemplary embodiments of the present invention will be described in detail based on the following figures, wherein:

FIG. 6A is inserted into the guide opening when viewed in the B direction in FIG. 7A.

DETAILED DESCRIPTION

Figure 1A:
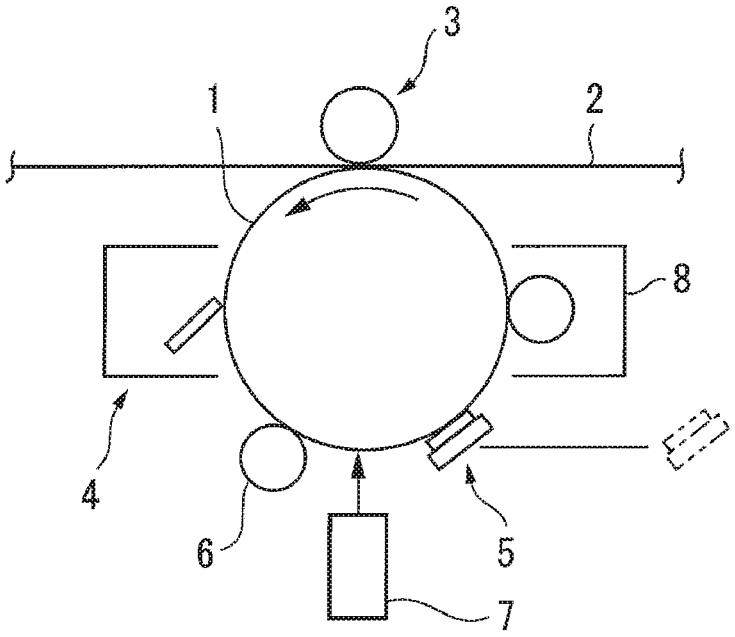
FIG. 1A is an explanatory view illustrating an outline of an exemplary embodiment of an image forming apparatus to which the present disclosure is applied.
Figure 1B:
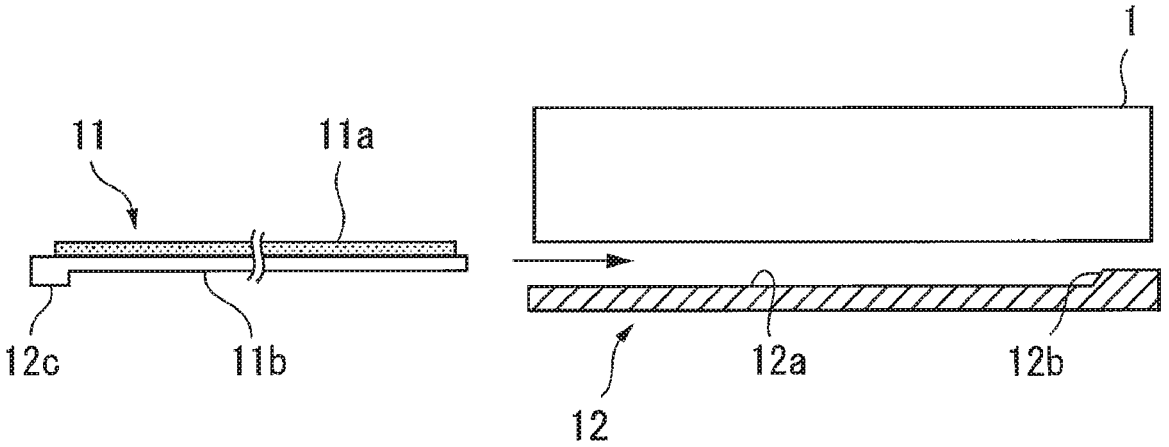
FIG. 1B is an explanatory view schematically illustrating a process of setting a cleaning tool in a representative aspect of a second cleaning unit (cleaning device) which is a configuration element of the image forming apparatus illustrated in FIG. 1A.
Figure 1C:
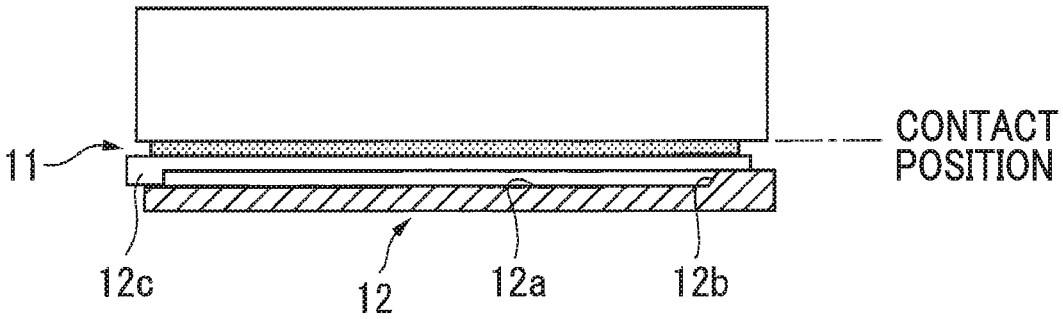
FIG. 1C is an explanatory view schematically illustrating a state where the cleaning tool is set in the same representative aspect.

Outline of Exemplary Embodiment FIG. 1A illustrates an outline of an exemplary embodiment of a cleaning device to which the present disclosure is applied and an image forming apparatus using the same, and FIGS. 1B and 1C illustrate explanatory view illustrating a main part of the cleaning device illustrated in FIG. 1A.

Referring to the drawing, a cleaning device 5 is a device that cleans the surface of an image holding unit 1 capable of holding an image foil led using an image forming material, the device including: a cleaning tool 11 that is movable along an intersecting direction intersecting with the moving direction of the image holding unit 1 and cleans the surface of the image holding unit 1 when placed in a contact position where the cleaning tool is in contact with the surface of the image holding unit 1; and a guiding unit 12 that guides the cleaning tool 11 so that the cleaning tool 11 moves from a non-contact position where the cleaning tool 11 is not in contact with the image holding unit 1 to the contact position for cleaning the surface of the image holding unit 1, in which when the image holding unit 1 is moved, the cleaning tool 11 placed in the contact position cleans the surface of the image holding unit 1.

In such technical means, the exemplary embodiment is premised on an aspect in which an image is formed using an image forming material (representatively, toner) and held on the surface of the image holding unit 1.

Here, the image holding unit 1 includes not only a member that forms and holds the image, such as a photosensitive body and a dielectric, but also a member that holds the formed image, such as an intermediate transfer body.

Furthermore, the cleaning device 5 cleans the surface of the image holding unit 1, and as illustrated in FIGS. 1B and 1C, may include the cleaning tool 11 and the guiding unit 12 that moves the cleaning tool 11 between a contact position and a non-contact position.

An example of a representative aspect of the cleaning tool 11 includes a member that is attachable to and detachable from the guiding unit 12. In this case, when the cleaning tool 11 is not used, the cleaning tool 11 may be stored in a place different from the guiding unit 12. In another aspect, the guiding unit 12 may hold the cleaning tool 11 in the non-contact position when the cleaning tool 11 is not used.

Next, a representative or preferred aspect of the cleaning device will be described.

First, an example of a representative aspect of the cleaning tool 11 includes an aspect in which a cleaning member Ha that is in contact with the surface of the image holding unit 1, and a support member 11*b* that supports the cleaning member 11*a*, are provided, and the support member 11*b* has a grip portion (not illustrated in FIGS. 1A, 1B and 1C) for gripping by a user at a position that projects from a region of the cleaning member 11*a*. In the example, it is possible for the user to easily perform in the operation of setting the cleaning tool 11 in the contact position by gripping the grip portion of the support member 11*b*.

In addition, an example of the representative aspect of the cleaning member 11*a* includes an aspect formed of a material that is elastically deformably in contact with the surface of the image holding unit 1 when being placed in the contact position. In the example, even when the contact position of the cleaning tool 11 is not set with extremely high accuracy, the contact state between the cleaning tool 11 set in the contact position and the surface of the image holding unit 1 is excellently maintained.

In addition, a typical mode of the guiding unit 12 has a holding portion 12*a* on which the cleaning tool 11 is detachably held. The holding portion 12*a* guides the cleaning tool 11 so that the cleaning tool 11 can be inserted to and drawn from one end of the image holding unit 1 in the intersecting direction. The holding portion 12*a* is configured to hold the cleaning tool 11 in the non-contact position during a period from an insertion start position in which the cleaning tool 11 starts to face a peripheral surface of the image holding unit 1 to immediately before the cleaning tool 11 reaches an insertion completion position in which the cleaning tool 11 is completely inserted to face the peripheral surface of the image holding unit 1 and to hold the cleaning tool 11 in the contact position at a stage when the cleaning tool 11 reaches the insertion completion position. In the example, the attachable and detachable type cleaning tool 11 may be stably guided, and the cleaning tool 11 may be held in the non-contact position with respect to the image holding unit 1 in the middle of the attaching and detaching operation, and the cleaning tool 11 may be held in the contact position when the mounting is completed.

Here, an example of a preferred aspect of the guiding unit 12 includes an aspect in which the cleaning tool 11 is guided to a step portion 12*b* formed at a terminal end of the holding portion 12*a* at the stage when the cleaning tool 11 has reached the insertion completion position and is held in the contact position. The example is an aspect in which the step portion 12*b* which can guide the cleaning tool 11 to the contact position when mounting of the attachable and detachable cleaning tool 11 is completed is provided. Furthermore, in order to hold the cleaning tool 11 in the contact position across the entire region in the intersecting direction of the image holding unit 1, for example, it is preferable that a projecting portion 12*c* that is in contact with the holding portion 12*a* of the guiding unit 12 is provided at a part opposite to the cleaning tool 11 in an insertion direction, and that a part opposite to a tip end side that is in contact with the step portion 12*b* in the cleaning tool 11 is held in the contact position by the projecting portion 12*c*.

In addition, the guiding unit 12 may be configured such that when the cleaning tool 11 is pulled out from the insertion completion position to the insertion start position, the cleaning tool 11 can be held in the non-contact position, similar to the operation of inserting the cleaning tool 11. Alternatively, in order to reduce the drop of any deposit from the cleaning tool 11 as much as possible, the guiding unit 12 may be configured such that the cleaning tool 11 can be pulled out while being in contact with the peripheral surface of the image holding unit 12.

In addition, in the exemplary embodiment, an image forming apparatus incorporating the above-described cleaning device 5 can be constructed. Specifically, as illustrated in FIG. 1A, the image forming apparatus includes: the image holding unit 1 that is capable of holding an image formed using an image forming material; a transfer unit 3 that transfers the image held by the image holding unit 1 to a transfer medium 2; a first cleaning unit 4 that removes a residue on the image holding unit 1; and a second cleaning unit 5 (that corresponds to the above-described cleaning device 5) that cleans the surface of the image holding unit 1 after cleaning by the first cleaning unit 4, in which the second cleaning unit 5 includes: the cleaning tool 11 that is movable along the intersecting direction intersecting with the moving direction of the image holding unit 1 and cleans the surface of the image holding unit 1 when placed in the contact position where the cleaning tool 11 is in contact with the surface of the image holding unit 1; and the guiding unit 12 that guides the cleaning tool 11 so that the cleaning tool 11 moves from the non-contact position where it is not in contact with the image holding unit 1 to the contact position for cleaning the surface of the image holding unit 1, in which when the image holding unit 1 is moved, the cleaning tool 11 placed in the contact position cleans the surface of the image holding unit 1.

In this case, the second cleaning unit 5 is installed taking into account possible deposition of deposits, which may fail to be removed by the first cleaning unit 4, on the image holding unit 1 over time.

Furthermore, in FIG. 1A, reference numeral 6 indicates a charging unit that charges the surface of the image holding unit 1, reference numeral 7 indicates a latent image writing unit that writes an electrostatic latent image on the charged surface of the image holding unit 1, and reference numeral 8 indicates a developing unit that develops the electrostatic latent image written on the surface of the image holding unit 1 with the image forming material (that corresponds to a developer).

Representative or preferred aspects of the image forming apparatus are as follows.

First, an example of a preferred aspect of the image forming apparatus having plural image holding units 1, includes an aspect in which the second cleaning unit 5 shares the cleaning tool 11. Although the second cleaning unit 5 may be placed on each of the plural image holding units 1, from the viewpoint of reducing the number of components, as the second cleaning unit 5, fewer (preferably one) cleaning tools 11 than the number of the image holding units 1 may be prepared and the cleaning tools 11 may be shared.

In addition, the second cleaning unit 5 may preferably be disposed upstream of the first cleaning unit 4 in the moving direction of the image holding unit 1. The second cleaning unit 5 may be disposed at any position of the image holding unit 1. The second cleaning unit 5 may preferably be disposed upstream of the first cleaning unit 4 in the moving direction of the image holding unit 1, so that even if any deposit is left unremoved after the cleaning by the second cleaning unit 5, such a deposit is more likely to be captured by the first cleaning unit 4 located downstream of the second cleaning unit 5 in the moving direction of the image holding unit 1, which improves the cleanness of the surface of the image holding unit 1.

In addition, an example of another preferred aspect of the second cleaning unit 5 is an aspect in which a notification unit (not illustrated in FIGS. 1A, 1B and 1C) for notifying the cleaning time is provided. The notification unit in the example may make notification periodically or through detecting the cause of generation of the image quality defect.

In addition, for example, the notification unit may include a detection unit (not illustrated in FIGS. 1A, 1B and 1C) that detects the state of any deposit on the surface of the image holding unit 1, and the notification unit may notifies the cleaning unit of the cleaning time based on the result of detection by the detection unit. In the example, the state of any deposit on the surface of the image holding unit 1 is monitored, and the cleaning time is notified when an allowable level is exceeded.

Furthermore, an example of another preferred aspect of the second cleaning unit 5 includes an aspect in which a position detection unit (not illustrated in FIGS. 1A, 1B and 1C) that determines whether or not the cleaning tool 11 is placed in the contact position is provided, and cleaning is performed when the position detection unit detects that the cleaning tool 11 is placed in the contact position. The example is an aspect in which it is detected that the cleaning tool 11 of the second cleaning unit 5 is placed in the contact position, and implementation of the cleaning is confirmed.

In addition, an example of another preferred aspect of the second cleaning unit 5 includes an aspect in which the position detection unit (not illustrated in FIGS. 1A, 1B and 1C) that determines whether the cleaning tool 11 is placed in the contact position is provided, and regular image forming processing is performed when the position detection unit detects that the cleaning tool 11 is not placed in the contact position. In the example, an aspect in which it is detected that the cleaning tool 11 of the second cleaning unit 5 is not placed in the contact position, and implementation of the regular image forming processing is confirmed, is employed.

Hereinafter, the present disclosure will be described in more detail based on the exemplary embodiment illustrated in the attached drawings.

Exemplary Embodiment 1

Entire Configuration of Image Forming Apparatus

Figure 2:
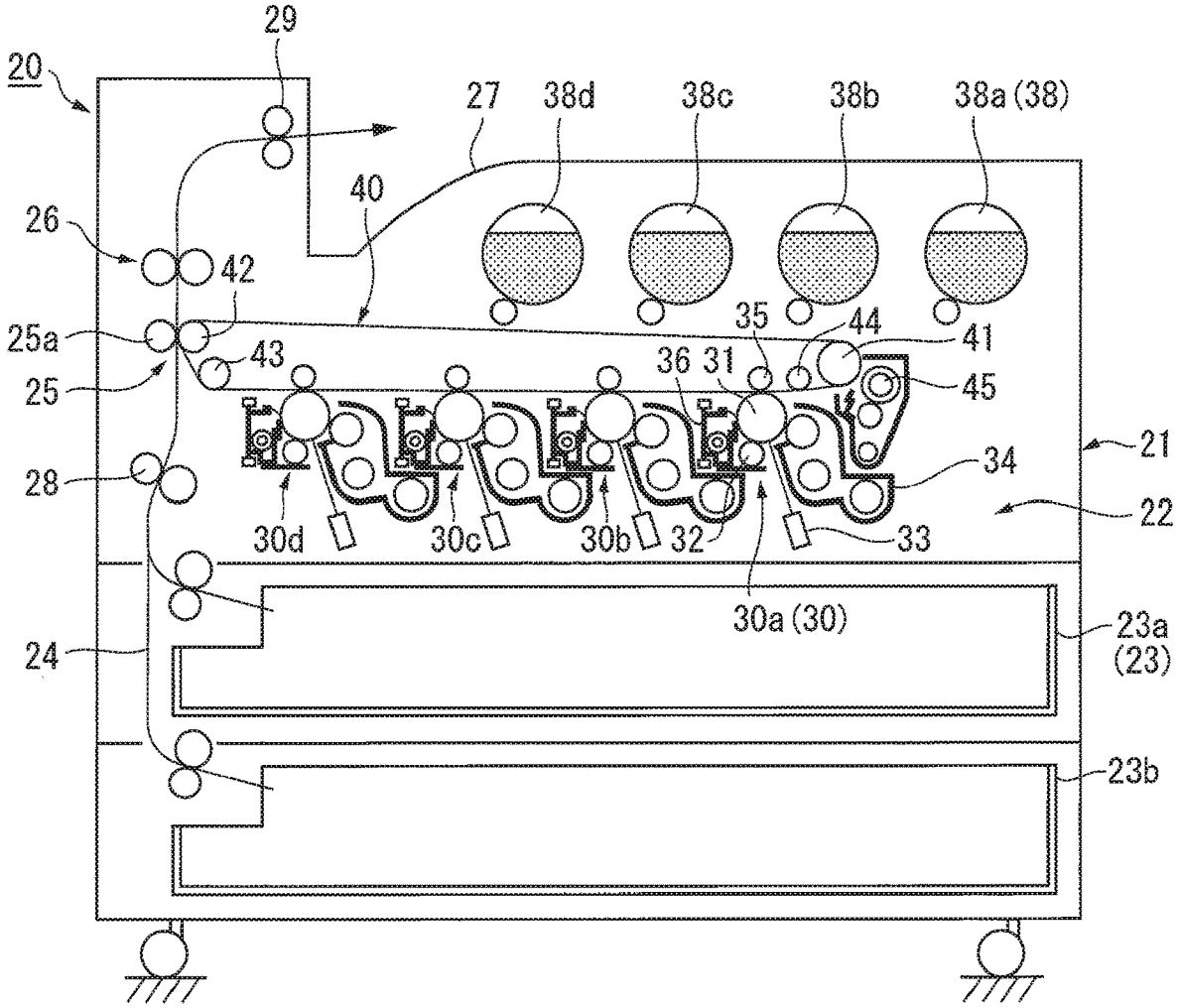
FIG. 2 is an explanatory view illustrating an entire configuration of an image forming apparatus according to Exemplary Embodiment 1.

FIG. 2 illustrates the entire configuration of the image forming apparatus according to Exemplary Embodiment 1.

Referring to the drawing, an image forming apparatus 20 includes: for example, an image forming engine 22 for producing plural color component images, which is installed in an image forming apparatus housing 21; and a paper supply container 23 (in the example, two-step paper supply containers 23*a* and 23*b*) for supplying the paper, which is provided below the image forming engine 22, in which the paper supplied from the paper supply container 23 is transported through a sheet transporting path 24 that extends along a substantially vertical direction, the image formed by the image forming engine 22 is transferred by a batch transfer device 25, the image transferred onto the paper is then fixed by a fixing device 26, and for example, the paper onto which the image is already fixed is output to a paper output receiver 27 provided at an upper portion of the image forming apparatus housing 21.

Image Forming Engine

In the example, the image forming engine 22 has plural image forming sections 30 (specifically, 30*a* to 30*d*) using plural color components (in the example, Y (yellow), M (magenta), C (cyan), and K (black)) toners to which an electrophotographic process is adopted, and batch-transfers (secondary transfer) the images on an intermediate transfer body 40 onto the paper by the batch transfer device 25 after primarily transferring each color component image produced by each image forming section 30 to the intermediate transfer body 40.

In the example, the image forming section 30 (30*a* to 30*d*) has, for example, a drum-shaped photosensitive body 31, and around the photosensitive body 31, a charging device 32 that charges the photosensitive body 31; a latent image writing device 33 that forms an electrostatic latent image on the charged photosensitive body 31; a developing device 34 that develops the electrostatic latent image formed on the photosensitive body 31 by each color component toner; a primary transfer device 35 that is provided on a rear surface of the intermediate transfer body 40 that faces the photosensitive body 31 and primarily transfers the image on the photosensitive body 31 to the intermediate transfer body 40; and a regular cleaning device 36 as the first cleaning unit that cleans the toner that remains on the photosensitive body 31 after the primary transfer, are sequentially disposed.

Furthermore, in the example, as the latent image writing device 33, for example, a device in which writing is separately performed by an LED array, for example, with respect to each of the image forming sections 30, but not being limited thereto, a common laser scanning device may be provided to write the electrostatic latent images of each color component by a laser beam with respect to each of the image forming sections 30, and laser scanning devices may be respectively provided. In addition, reference numeral 38

(specifically, 38*a* to 38*d*) indicates a toner cartridge for replenishing each color component toner to each developing device 34 of each image forming section 30 (30*a* to 30*d*).

Further, in the example, the intermediate transfer body 40 is formed of, for example, a belt-shaped member that stretches over plural tension rolls 41 to 44, and for example, the tension roll 41 is driven to be capable of circulating and rotating in a predetermined direction as a driving roll, and the tension roll 43 functions as a tension applying roll for applying a desired tension to the intermediate transfer body 40.

Furthermore, reference numeral 45 indicates an intermediate transfer body cleaning device for removing the residue (toner, paper dust, and the like) from the intermediate transfer body 40.

In the example, the batch transfer device 25 includes a transfer roll 25*a* that is rotatably in contact with the surface of the intermediate transfer body 40, and the tension roll 42 of the intermediate transfer body 40 is used as a counter electrode, and by forming a desired transfer electric field between the transfer roll 25*a* and the counter electrode, the image held on the intermediate transfer body 40 is batch-transferred onto the paper.

In addition, on an inlet side of the batch transfer device 25 in the sheet transporting path 24, a positioning roll 28 is provided which positions the paper to be sent to the batch transfer device 25, and an output roll 29 is provided immediately in front of the paper output receiver 27 of the sheet transporting path 24.

Process Cartridge

Figure 3:
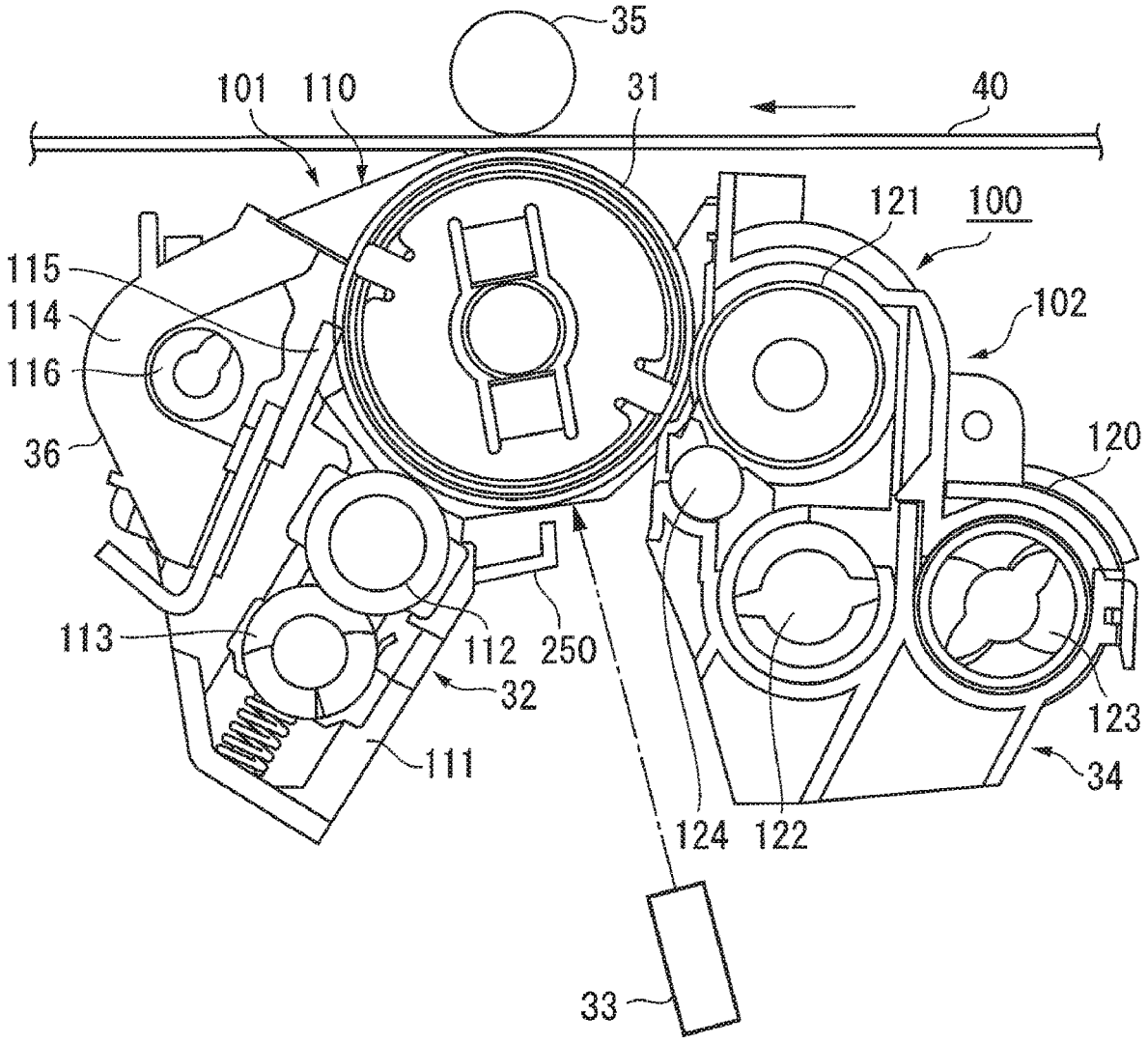
FIG. 3 is an explanatory view illustrating the details of each image forming section in Exemplary Embodiment 1.

In the exemplary embodiment, as illustrated in FIG. 3, each image forming section 30 is configured as a process cartridge 100 in which the photosensitive body 31, the charging device 32, the developing device 34, and the cleaning device 36 are integrated and which is detachably mounted to the cartridge receiving section (not illustrated) of the image forming apparatus housing 21.

In particular, in the example, the process cartridge 100 includes: a photosensitive cartridge 101 in which the photosensitive body 31 is incorporated; and a developing cartridge 102 which is provided to face the photosensitive cartridge 101, and in which the developing device 34 is incorporated, and the photosensitive cartridge 101 and the developing cartridge 102 are deposited on and detached from the corresponding part of the cartridge receiving section of the image forming apparatus housing 21.

Photosensitive Cartridge

In the example, as illustrated in FIG. 3, the photosensitive cartridge 101 has a storage container 110 in which the photosensitive body 31 is stored, and the charging device 32 and the cleaning device 36 are disposed around the photosensitive body 31 in the storage container 110.

Here, both end portions of a rotating shaft of the photosensitive body 31 are supported to be rotatable at both ends of the storage container 110, and one end of the rotating shaft of the photosensitive body 31 is driven and connected to a driving mechanism (not illustrated) when mounting the photosensitive cartridge 101.

In addition, the charging device 32 includes: a charging container section 111 provided at a part of the storage container 110; a charging roll 112 that is in contact with or in the vicinity of the surface of the photosensitive body 31 in the charging container section 111; and a cleaning roll 113 that cleans the charging roll 112.

Furthermore, the cleaning device 36 includes: a cleaning container section 114 at a part of the storage container 110; a plate-shaped cleaning member 115 that scrapes off the residual toner on the surface of the photosensitive body 31, at an opening edge of the cleaning container section 114; and a recovery transport member (for example, an aspect in which a spiral blade is attached around the rotating shaft) 116 by which the residual toner scraped off by the cleaning member 115 is transported toward a recovery container (not illustrated), in the cleaning container section 114.

Developing Cartridge

As illustrated in FIG. 3, the developing cartridge 102 includes a developing container 120 which is open toward the photosensitive body 31 and in which a two-component developer containing toner and carrier is stored, a developing roll 121 that holds and transports the developer is disposed at the part that faces the opening of the developing container 120, one pair of developer stirring members (for example, an aspect in which the spiral blade is attached around the rotating shaft) 122 and 123 are disposed on a rear surface side of the developing roll 121 in the developing container 120, and further, a layer thickness regulating member (for example, layer thickness regulating roll) 124 that regulates a developer layer thickness held by the developing roll 121 is provided upstream of the development part in a rotational direction of the developing roll 121.

In addition, in the example, a pivot shaft (not illustrated) is provided on a far side of the cartridge receiving section of the image forming apparatus housing 21, and a bearing section (not illustrated) into which the pivot shaft is inserted is provided on the far side of the developing container 120. Therefore, the developing cartridge 102 can swing around the pivot shaft of the developing container 120 as a rotation fulcrum.

Furthermore, in the example, tracking rollers (not illustrated) for position adjustment slightly larger than the diameter of the developing roll 121 are provided at both ends of the developing roll 121, the tracking roller comes into contact with the surface of the photosensitive body 31, and accordingly, a gap between the developing roll 121 and the photosensitive body 31 is adjusted to a predetermined amount.

Furthermore, the developing cartridge 102 is biased to the photosensitive cartridge 101 side by respective biasing springs (not illustrated) in the vicinity of both ends in the longitudinal direction, and a positional relationship with the photosensitive cartridge 101 is maintained in a state where the tracking roller is in contact with the photosensitive body 31.

Necessity of Cleaning Device for Maintenance

In the exemplary embodiment, the residue (residual toner, dust, and the like) deposited on the surface of the photosensitive body 31 is removed by the regular cleaning device 36. During long time service of the photosensitive body 31, the deposit on the surface of the photosensitive body 31, specifically, an external additive in the toner may be deposited to form a film, which is so-called filming, and this may reduce image quality.

In general, the toner is mostly made of a binder resin, and the necessary function is imparted by dispersing a colorant, a charge control agent, a release agent, an external additive and the like in the resin. In particular, the external additive is to add fine powder, such as colloidal silica, titanium oxide, alumina, and fatty acid metal salt, to the toner surface for the purpose of improving the toner fluidity, adjusting the triboelectric charge amount, and improving the cleaning properties, and the particle size of the external additive is approximately from submicron to 10 nm and is smaller than that of toner particles. Therefore, although the residual toner can be removed by the plate-shaped cleaning member 115 in the regular cleaning device 36, the external additive having a smaller diameter than that of the toner easily slips through the plate-shaped cleaning member 115, and when the photosensitive body 31 is used over time, this leads to a phenomenon in which filming caused by the external additive is easily formed on the surface of the photosensitive body 31.

Known countermeasures to prevent such filming include, for example, a cleaning brush, called a disturber brush, which is provided separately from the plate-shaped cleaning member 115 in the regular cleaning device 36 and comes into contact with the photosensitive body to mechanically scrape off the filming from the surface of the photosensitive body; and a cleaning brush to which a voltage is applied to electrically remove the film from the surface of the photosensitive body (refer to JP2002-351279A).

However, since providing this type of the cleaning brush causes the cost increase as the cleaning device 36, the cleaning brush is mounted on a high-speed machine, but an aspect in which this type of cleaning brush is not provided in a low-speed or middle-speed machine and is provided only in the plate-shaped cleaning member 115 is adapted in many cases.

In such an aspect, in addition to cleaning of the residual toner which is the principal purpose, the plate-shaped cleaning member 115 also has a function of partially scraping off the filming deposited on the surface of the photosensitive body 31, but when the contact pressure of the plate-shaped cleaning member 115 against the surface of the photosensitive body 31 is set to be high, the contact resistance against the photosensitive body 31 in an image forming cycle becomes extremely large, and thus, when setting the contact pressure of the plate-shaped cleaning member 115, it is difficult to set the necessary contact pressure to be sufficient for scraping off the filming. Therefore, in particular, for many users who perform printing with high image density, the amount of external additive deposited on the surface of the photosensitive body 31 also increases, and it is difficult to completely remove the filming only by the plate-shaped cleaning member 115, and when the image is held on the remaining portion of the filming of the photosensitive body 31, there is a concern that this causes the image quality defect (white spots).

Figure 5:
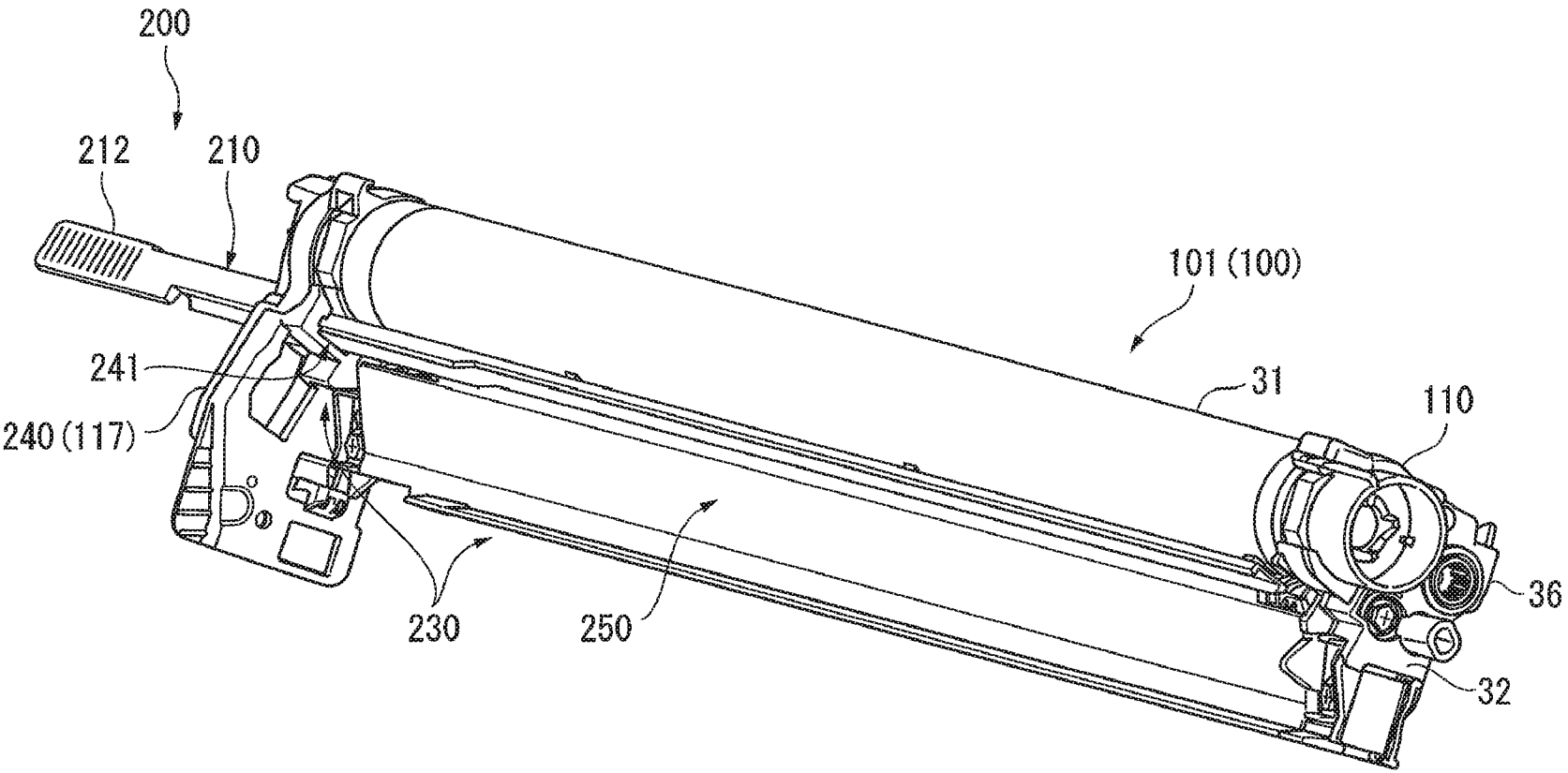
FIG. 5 is an explanatory view illustrating a state where a second cleaning device that is attachable to and detachable from the photosensitive cartridge is mounted.

Therefore, in the exemplary embodiment, as illustrated in FIG. 5, a method in which a cleaning device 200 for maintenance is detachably mounted on the process cartridge 100 (in the example, photosensitive cartridge 101) as the second cleaning unit, and the surface of the photosensitive body 31 is maintained by mounting the cleaning device 200 for maintenance when it is necessary to clean the filming deposited on the surface of the photosensitive body 31 over time, is adapted.

Configuration Example of Cleaning Device for Maintenance

Figure 4:
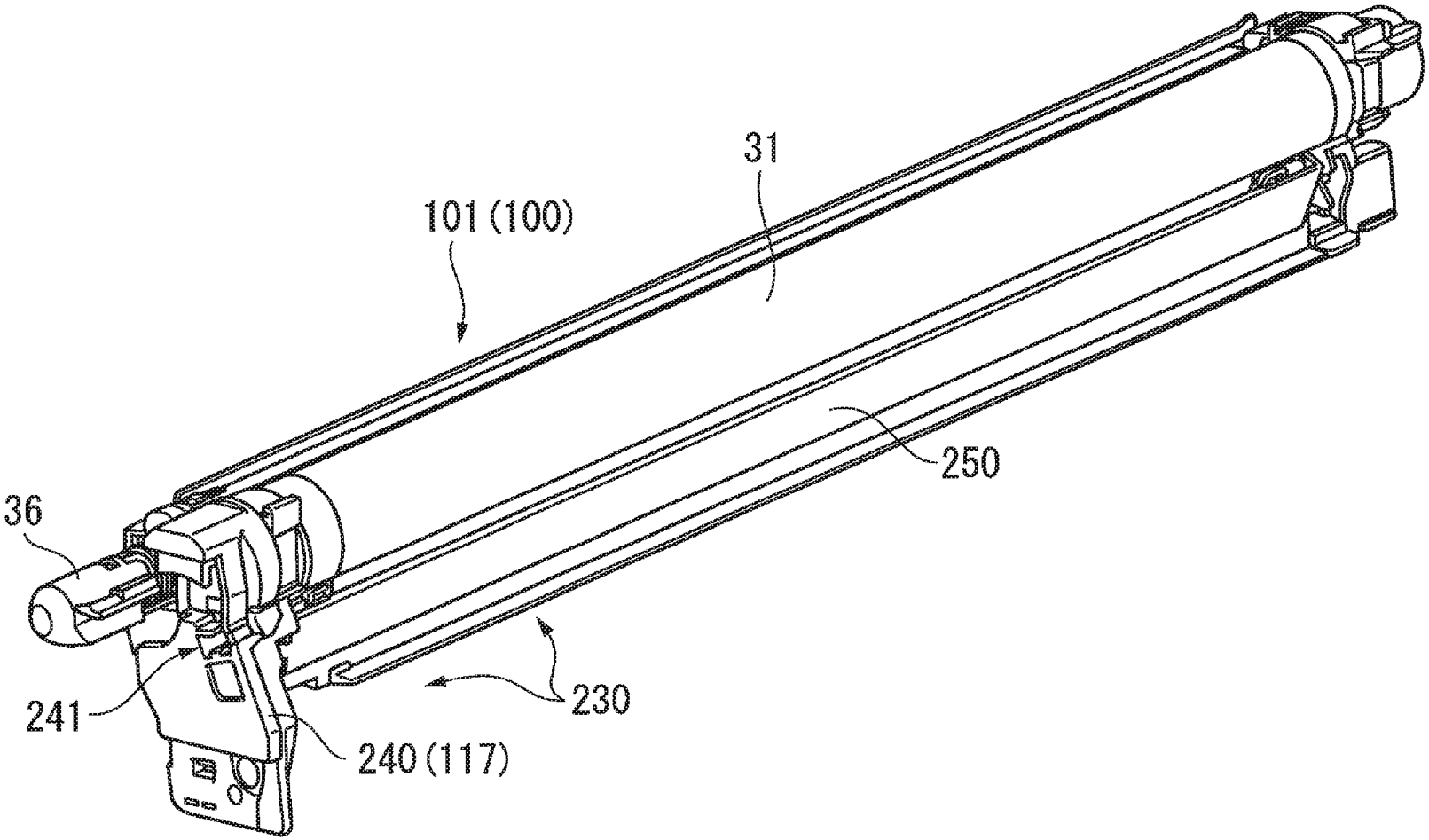
FIG. 4 is an explanatory view illustrating a photosensitive cartridge of a process cartridge used in Exemplary Embodiment 1.

In the exemplary embodiment, as illustrated in FIGS. 3 to 5, the cleaning device 200 for maintenance is disposed downstream of the charging device 32 in the moving direction of the photosensitive body 31 and upstream of the developing device 34 in the moving direction of the photosensitive body 31, around the photosensitive body 31 of each image forming section 30 (30*a* to 30*d*).

In addition, the cleaning device 200 includes: a cleaning rod 210 as a cleaning tool that can be inserted and extracted from the outside of the image forming apparatus housing 21 when it is necessary to clean filming deposited on the surface of the photosensitive body 31 over time; and a guide mechanism 230 which is provided at a part of the storage container 110 of the photosensitive cartridge 101 of the process cartridge 100, and serves as a guiding unit that guides the cleaning rod 210 to be insertable and extractable.

In the example, the cleaning rod 210 is not provided exclusively for each of the image forming sections 30 (30*a* to 30*d*), and for example, one cleaning rod is provided and shared in the cleaning device 200 of the plural image forming sections 30.

Cleaning Rod

Figure 6A:
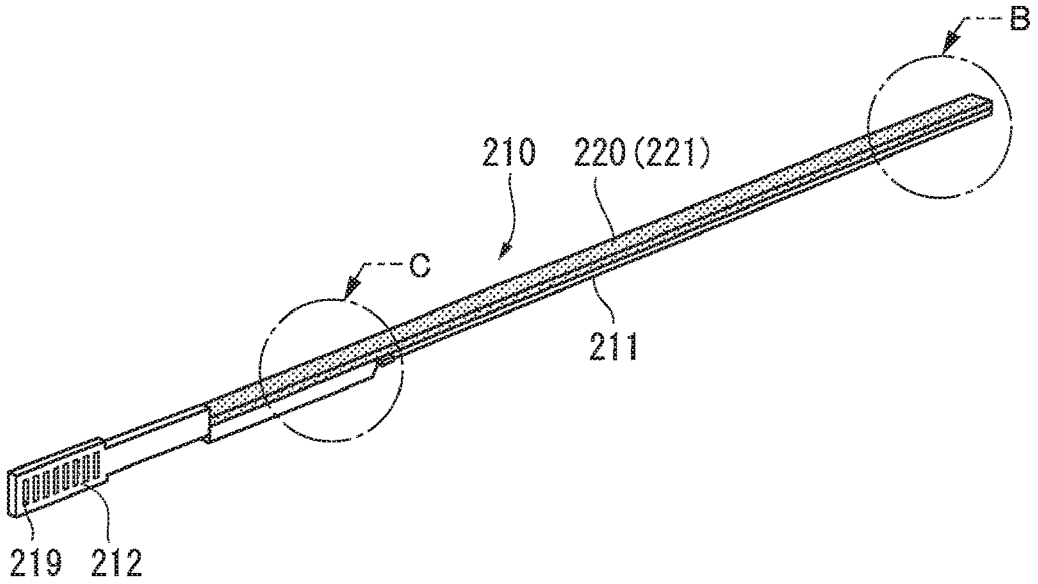
FIG. 6A is a perspective view illustrating an entire configuration of the cleaning tool of the second cleaning device.

In the example, as illustrated in FIGS. 5 and 6A, the cleaning rod 210 includes: a support plate 211 as a long plate-shaped support member made of synthetic resin, such as polypropylene resin, or metal, such as aluminum; and a cleaning pad 220 as a cleaning member that forms a grip portion 212 for gripping by the user on one end side of the support plate 211 in the longitudinal direction, and extends along the longitudinal direction in the plate main body section 213 excluding the grip portion 212 of the support plate 211.

In the example, when the cleaning by the cleaning device 200 for maintenance is not performed, the cleaning rod 210 may be removed from the guide mechanism 230 and may be stored in any place, such as a storage place provided in an inner part of the image forming apparatus housing 21.

Support Plate

Figure 6B:
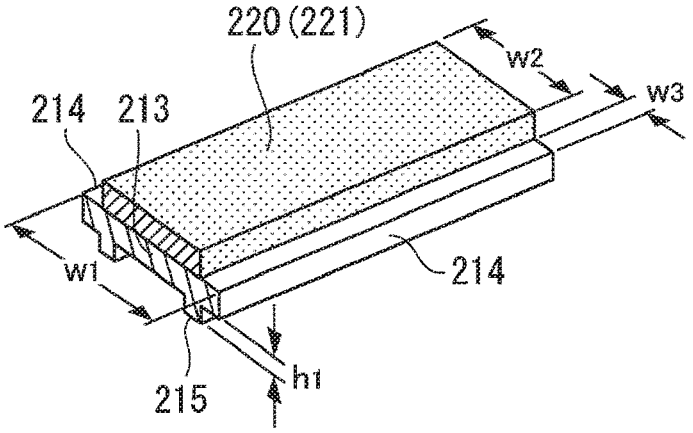
FIG. 6B is an enlarged explanatory view of a part B in FIG. 6A.

In the example, as illustrated in FIGS. 6A and 6B, the support plate 211 has a long flat plate-shaped plate main body section 213 with a width dimension w1. A long flat plate-shaped cleaning pad 220 with a width dimension w2 (w2<w1) is attached to the surface of the plate main body section 213 so that both transverse sides of the plate main body section 214 protrude from the both transverse sides of the cleaning pad 220 by w3 (equal to (w1−w2)/2 in the example) to form protruding sections 214.

Furthermore, one pair of projections 215 that extends along the longitudinal direction of the plate main body section 213 is provided on the rear surface side of the plate main body section 213, and the projections 215 are respectively formed such that the width dimension between the outer side surfaces to be substantially approximately the same as the width dimension w2 of the cleaning pad 220, and have a rectangular sectional shape that projects from the rear surface of the plate main body section 213 by a dimension h1.

Figure 6C:
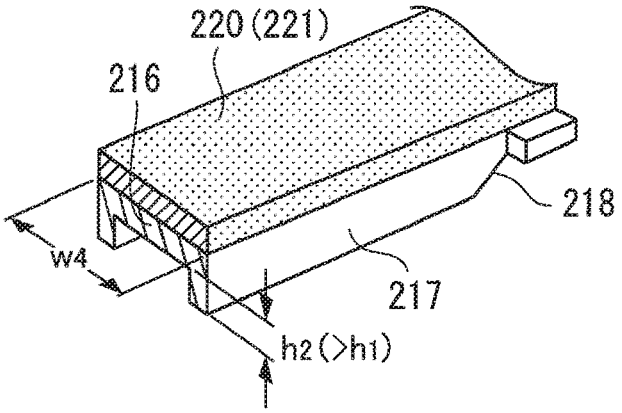
FIG. 6C is an enlarged explanatory view of a part C in FIG. 6A.

In addition, near the grip portion 212 in the plate main body section 213, as illustrated in FIGS. 6A and 6C, the plate main body section 213 is formed as narrow width section 216 having a width dimension w4 (in the example, w4=w2) from which the protruding section 214 is removed, further, one pair of projections 215 is formed as a stepped section 217 of which a projection dimension is changed to 112 (in the example, h2>h1), and an inclined portion 218 of which a projection dimension gradually increases toward the grip portion 212 side is formed at a boundary part between the stepped section 217 and the projection 215.

Furthermore, the grip portion 212 is formed in a flat plate shape that extends along a direction substantially orthogonally intersecting with the plate main body section 213, and has groove sections 219 arranged in a ladder shape, for example, for easy gripping near the tip end thereof.

Cleaning Pad

In this example, as illustrated in FIGS. 6A to 6C, the cleaning pad 220 may be formed of a material that can be elastically deformed in the thickness direction, and for example, may use a sponge material 221 obtained by foam molding a rigid resin, such as polyurethane.

Figure 8A:
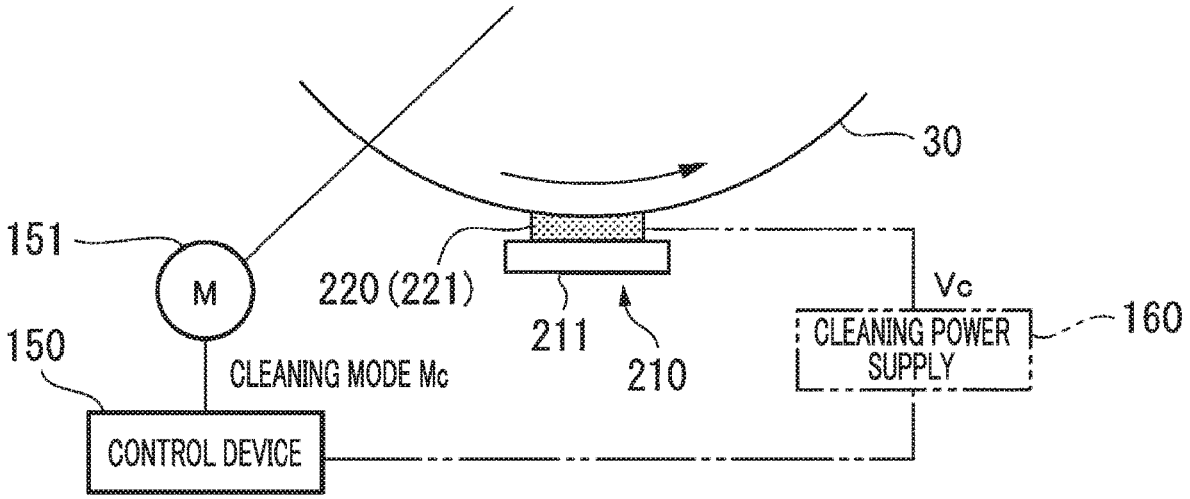
FIG. 8A is an explanatory view schematically illustrating a state where the cleaning tool of the second cleaning device is set in a contact position.
Figure 8B:
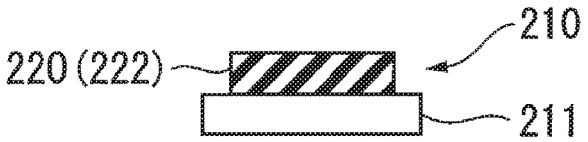
FIGS. 8B to 8D are explanatory views illustrating other configuration examples of the cleaning tool illustrated in FIG. 8A.
Figure 8C:
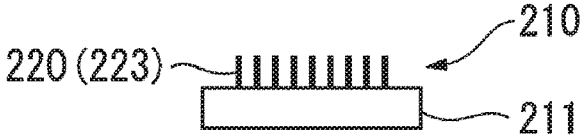
Figure 8D:
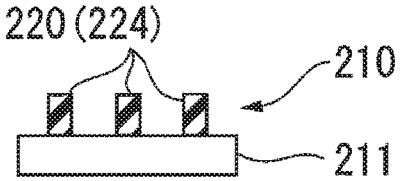

Furthermore, the cleaning pad 220 is not limited to the sponge material 221 as long as the cleaning pad can be elastically deformed when coming into contact with the surface of the photosensitive body 31 and can clean the surface of the photosensitive body 31, and for example, as illustrated in FIG. 8B, elastic rubber 222 may be used, or as illustrated in FIG. 8C, a brush material 223 in which a large number of conductive brush fibers are disposed may be used, or as illustrated in FIG. 8D, plural divided elastic rubbers 224 arranged at appropriate intervals along the moving direction of the photosensitive body 31 may be used. In particular, as illustrated in FIG. 8D, when the plural divided elastic rubbers 224 are used, the number of times of substantial contact between the photosensitive body 31 and the cleaning pad 220 can be increased compared to a single configuration, and accordingly, it is effective in improving the cleaning performance by the cleaning pad 220.

Guide Mechanism

In the exemplary embodiment, as illustrated in FIGS. 3 to 5, 7, and 9, the guide mechanism 230 includes: a regulation frame 240 that regulates an insertion trajectory of the cleaning rod 210 while maintaining the non-contact position P1 (refer to FIG. 9A) that is in non-contact with the surface of the photosensitive body 31 when the cleaning rod 210 is set to be in the contact position; and a guide rail 250 that guides the cleaning rod 210 of which the insertion trajectory is regulated by the regulation frame 240 and sets the cleaning rod 210 to be in a contact position P2 (refer to FIG. 9B) that is in contact with the surface of the photosensitive body 31 when the insertion of the cleaning rod 210 is completed.

Regulation Frame

Figure 7A:
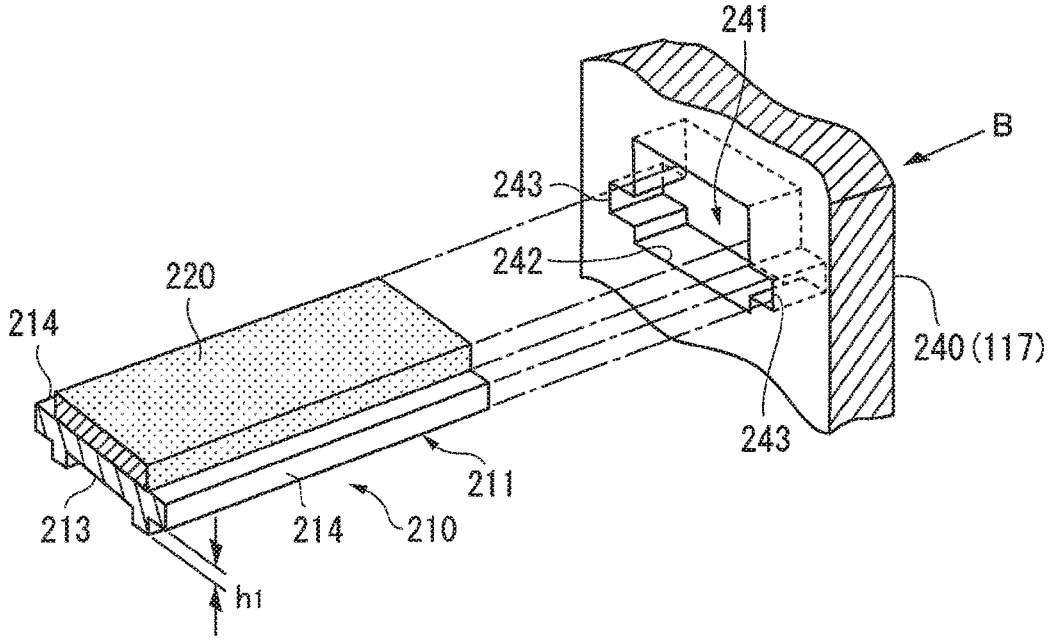
FIG. 7A is an explanatory view illustrating a relationship between the cleaning tool of the second cleaning device and a guide opening of a photosensitive cartridge housing.

In the example, in the regulation frame 240, as illustrated in FIGS. 4, 5, and 7A, a guide hole 241 through which the cleaning rod 210 can be inserted and extracted is open in an end portion container section 117 that rotatably holds the end portion of the photosensitive body 31 in the storage container 110 of the photosensitive cartridge 101 of the process cartridge 100. In the example, the guide hole 241 includes: an insertion path 242 having a substantially rectangular section and having a width dimension slightly larger than the width dimension w2 of the cleaning pad 220 and a height dimension larger than the maximum thickness dimension of the cleaning rod 210 in the cleaning rod 210; and regulation grooves 243 provided on both side surfaces in the width direction of the inner surface of the insertion path 242, and formed to be cut so as to make the protruding section 214 of the cleaning rod. 210 be capable of passing therethrough in a state where a projecting end of the projection 215 of the cleaning rod 210 is in contact with the bottom surface of the insertion path 242 as illustrated in FIGS. 7A and 7B.

Figure 7B:
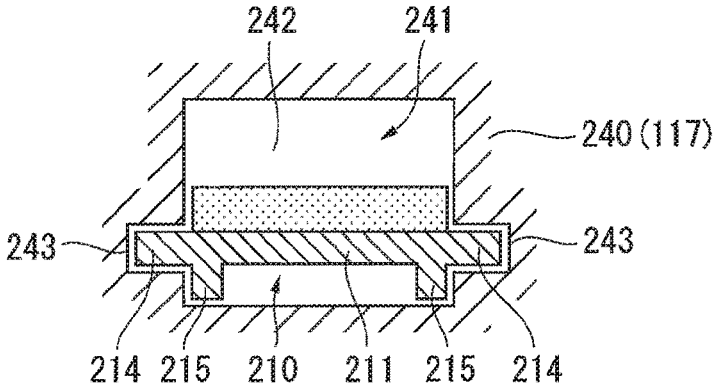
FIG. 7B is an arrow view schematically illustrating a state where the part B of the cleaning tool illustrated

In the example, as illustrated in FIG. 7A, when the cleaning rod 210 is inserted into the guide hole 241 of the regulation frame 240, since the cleaning rod 210 is, as illustrated in FIG. 7B, inserted in a state where the protruding section 214 of the cleaning rod 210 is regulated by the regulation groove 243 of the guide hole 241, the cleaning rod 210 is inserted while maintaining a substantially parallel posture along an axial direction of the photosensitive body 31.

Figure 7C:
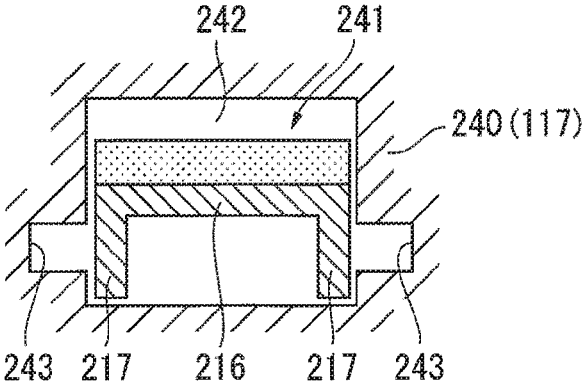
FIG. 7C is an arrow view schematically illustrating a state where the part C of the cleaning tool illustrated in FIG. 6A is inserted into the guide opening when viewed from the B direction in FIG. 7A.

In addition, the narrow width section 216 and the stepped section 217 of the cleaning rod 210 are inserted into the guide holes 241 of the regulation frame 240. At this stage, as illustrated in FIG. 7C, the protruding section 214 of the cleaning rod 210 is removed from the regulation groove 243 of the guide hole 241, and as a result, the stepped section 217 of the cleaning rod 210 is lifted up so that a grip portion 212-side part of the cleaning pad 220 is lifted up.

Guide Rail

In the exemplary embodiment, as illustrated in FIGS. 3 to 5 and FIGS. 9A and 9B, the guide rail 250 has a long rail member 251 provided at a part of the storage container 110 of the photosensitive cartridge 101, and the rail member 251 is molded by a rigid resin material having a relatively high flexural rigidity, such as, for example, ABS resin, and extends along the axial direction of the photosensitive body 31 and is disposed at a position separated from the surface of the photosensitive body 31.

In addition, a holding portion 252 that embraces and holds the support plate 211 of the cleaning rod 210 to be guidable is provided along the longitudinal direction on the surface of the rail member 251 that faces the photosensitive body 31, a step portion 253 that projects toward the surface side of the photosensitive body 31 is provided at a part positioned to be opposite to the regulation frame 240 of the holding portion 252, and an inclined portion 254 inclined in a direction of approaching the photosensitive body 31 toward the step portion 253 is provided at a boundary part with the step portion 253 of the holding portion 252.

Operation Example of Cleaning Device for Maintenance

Next, an operation example of the cleaning device for maintenance according to the exemplary embodiment will be described.

Now, assuming that cleaning is not necessary for the filming state caused by the external additive on the surface of the photosensitive body 31, the cleaning rod 210 is not inserted into the guide mechanism 230, and thus, there is no concern that the cleaning pad 220 of the cleaning rod 210 comes into contact with the surface of the photosensitive body 31. Therefore, when the cleaning device 200 for maintenance is not used, there is no concern that the contact resistance by the cleaning device 200 against the photosensitive body 31 increases.

Meanwhile, in a case where it is necessary to clean the filming state caused by the external additive on the surface of the photosensitive body 31, the cleaning device 200 for maintenance of the corresponding image forming section 30 (any of 30*a* to 30*d*) may be used, and the surface of the photosensitive body 31 may be cleaned.

Setting Work of Cleaning Rod

First, the user may grip the grip portion 212 of the cleaning rod 210 and insert the tip end portion opposite to the grip portion 212 of the cleaning rod 210 into the guide hole 241 of the regulation frame 240 of the guide mechanism 230.

At this time, as illustrated in FIGS. 7A and 7B, since the cleaning rod 210 is inserted in a state where the protruding section 214 of the cleaning rod 210 is regulated by the regulation groove 243 of the guide hole 241, the cleaning rod 210 is inserted while maintaining a substantially parallel posture along the axial direction of the photosensitive body 31. In addition, the inserted cleaning rod 210 is guided while being held by the holding portion 252 of the guide rail 250 as illustrated in FIG. 9A, but the insertion posture of the cleaning rod 210 is regulated by the regulation frame 240, and thus, when the cleaning rod 210 is inserted, the cleaning rod 210 is guided along the non-contact position P1 which is not in contact with the surface of the photosensitive body 31, and there is no concern that the cleaning pad 220 of the cleaning rod 210 comes into contact with the surface of the photosensitive body 31.

As the user further inserts the cleaning rod 210, as illustrated in FIGS. 7A and 7C, the protruding section 214 of the cleaning rod 210 is removed from the regulation groove 243 of the guide hole 241, and the narrow width section 216 and the stepped section 217 of the cleaning rod 210 are inserted into the guide holes 241 of the regulation frame 240. As a result, the stepped section 217 of the cleaning rod 210 is lifted up so that a grip portion 212-side part of the cleaning pad 220 is lifted up.

Figure 9A:
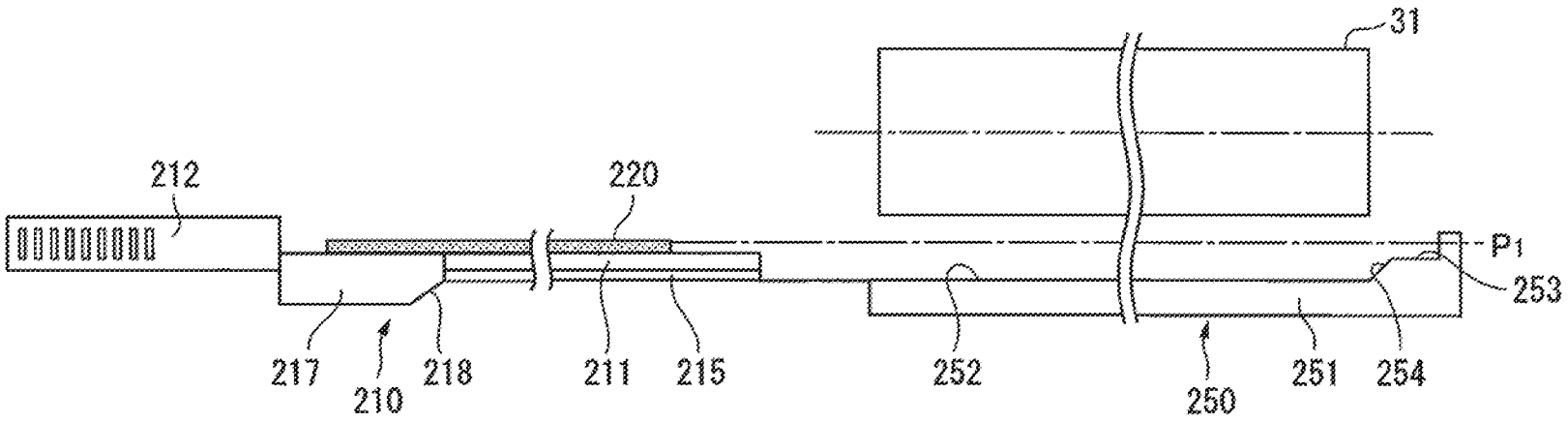
FIG. 9A is an explanatory view schematically illustrating an operation process of setting the cleaning tool of the second cleaning device.
Figure 9B:
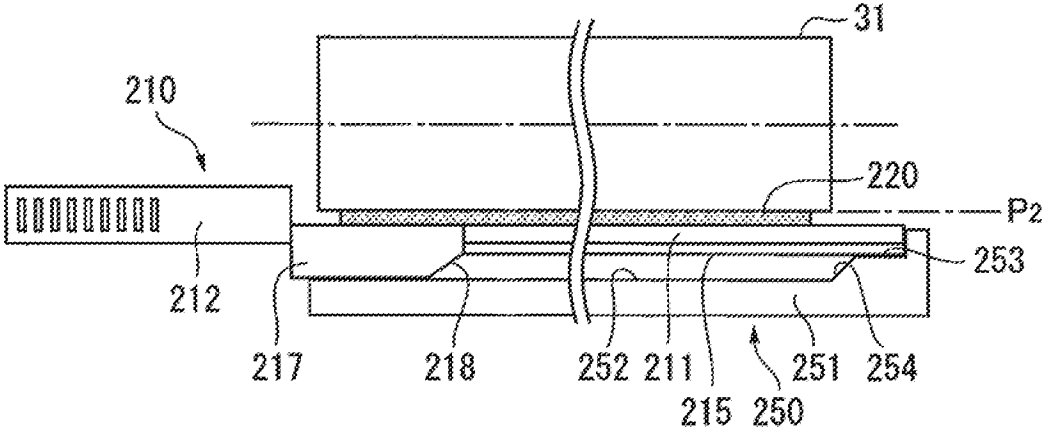
FIG. 9B is an explanatory view schematically illustrating a state where the setting of the cleaning tool of the second cleaning device is completed.

Meanwhile, as illustrated in FIGS. 9A and 9B, after the tip end portion of the cleaning rod 210 in the longitudinal direction is guided along the holding portion 252 of the guide rail 250, when the cleaning rod 210 reaches the insertion completion position, the tip end portion of the cleaning rod 210 in the longitudinal direction is guided to the step portion 253 along the inclined portion 254 and lifted upward so as to approach the photosensitive body 31 side. In addition, the stepped section 217 near the rear end of the cleaning rod 210 in the longitudinal direction also rides over the holding portion 252 of the guide rail 250, and the cleaning rod 210 is placed in the contact position P2 which comes into contact with the surface of the photosensitive body 31.

At this time, by selecting an optimal position as the contact position P2 of the cleaning rod 210, the contact pressure of the cleaning rod 210 with respect to the surface of the photosensitive body 31 is optimally selected.

In this state, as illustrated in FIG. 8A, when the user selects a cleaning mode Mc at a timing different from a regular image forming mode, a drive motor 151 of the photosensitive body 31 rotates based on a control signal from the control device 150, and accordingly, the cleaning pad 220 of the cleaning rod 210 cleans the surface of the photosensitive body 31, and filming caused by the external additive deposited on the surface of the photosensitive body 31 is removed.

In the example, as the cleaning mode Mc, the photosensitive body 31 may rotate in a forward or reverse direction for a predetermined time, or may rotate intermittently at predetermined time intervals.

Furthermore, when necessary, at least the cleaning pad 220 of the cleaning rod 210 is configured of a conductive member, and a cleaning bias Vc (positive or negative polarity) from a cleaning power supply 160 is applied to the cleaning pad 220, and an electrical scraping action by a cleaning electric field may be applied in addition to the mechanical scraping action by the cleaning pad 220.

Removing Work of Cleaning Rod

When the cleaning is completed by the cleaning rod 210, the user may grip the grip portion 212 of the cleaning rod 210 and pull out the cleaning rod 210 from the guide hole 241 of the regulation frame 240 of the guide mechanism 230.

At this time, when the cleaning rod 210 positioned in the contact position P2 is pulled out, substantially similar to the setting work of the cleaning rod 210, the cleaning rod 210 is held by the holding portion 252 at the stage when the tip end portion of the cleaning rod 210 is removed from the step portion 253 of the guide rail 250, and after this, the cleaning rod 210 may be pulled out along the holding portion 252 in a state of being held in the non-contact position P1. In addition, after removing dirt (a deposit such as an external additive) deposited on the cleaning pad 220 of the pulled-out cleaning rod 210, the cleaning rod 210 may be stored in a predetermined storage place.

Here, when the cleaning rod 210 is pulled out after the cleaning rod 210 is separated from the photosensitive body 31 to the non-contact position P1, the deposit on the cleaning pad 220 of the cleaning rod 210 may partially fall into the device, such as the holding portion 252 of the guide rail 250. Taking this point into consideration, in order to minimize the fall of the deposit from the cleaning rod 210, for example, as illustrated in FIGS. 6A and 6B, it is preferable that the height direction dimension of the regulation groove 243 of the guide hole 241 of the regulation frame 240 is set to a predetermined amount (corresponds to a gap amount between the contact position P2 and the non-contact position P1 in the example) to be larger than the height dimension of the protruding section 214 of the cleaning rod 210, the insertion trajectory of the cleaning rod 210 is held in the non-contact position P1 by bringing the protruding section 214 into contact with the lower side surface of the regulation groove 243 when performing the insertion operation of setting the cleaning rod 210, and when performing the pulling-out operation of removing the cleaning rod 210, the operation of pulling out the cleaning rod 210 is performed while holding the contact state between the peripheral surface of the photosensitive body 31 and the cleaning rod 210 by bringing the protruding section 214 into contact with upper side surface of the regulation groove 241

Arrangement Check of Cleaning Rod

Figure 10A:
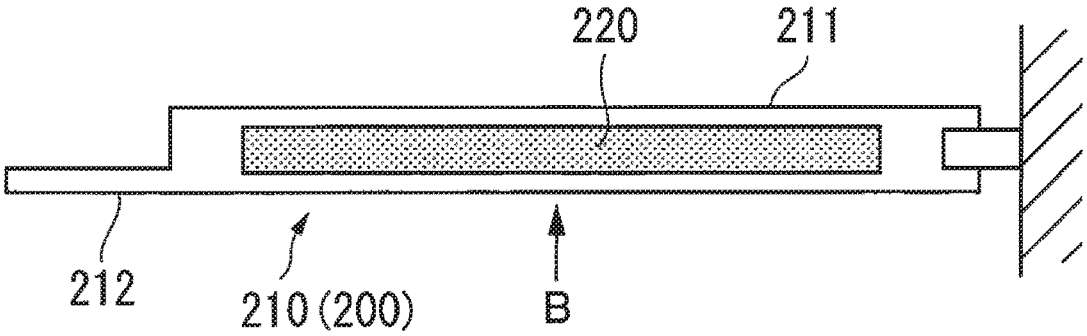
FIG. 10A is an explanatory view illustrating an example of a position detection system for detecting that the cleaning tool of the second cleaning device is set in the contact position.
Figure 10B:
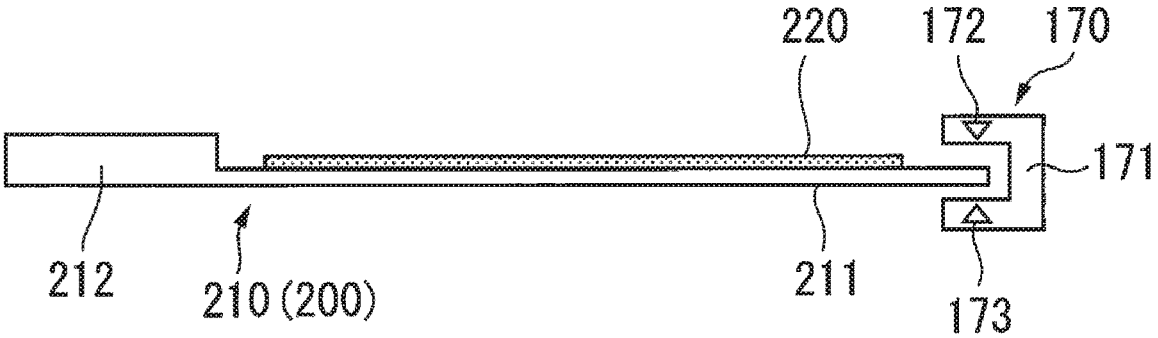
FIG. 10B is an arrow view when viewed from the B direction of FIG. 10A.

In the exemplary embodiment, as illustrated in FIGS. 10A and 10B, a position detector 170 that detects whether the cleaning rod 210 of the cleaning device 200 for maintenance is placed in the contact position P2 (refer to FIG. 9B) is provided. This type of position detector 170 is configured of, for example, a photocoupler 171 in which a light emitting element 172 and a light receiving element 173 are disposed to face each other, and can determine whether a part (in the example, tip end portion in the longitudinal direction) of the cleaning rod 210 positioned in the contact position P2 passes through a detection light path of the position detector 170.

Figure 10C:
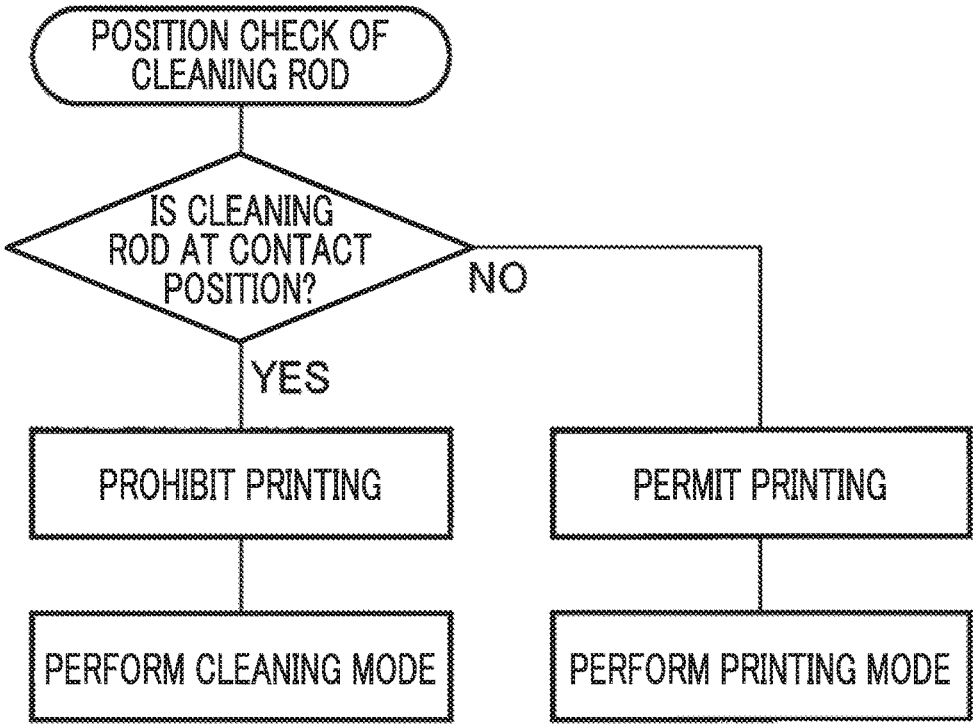
FIG. 10C is a flowchart illustrating arrangement check processing of the cleaning tool.

Therefore, as illustrated in FIG. 10C, it is determined from the output result of the position detector 170 whether the cleaning rod 210 is in the contact position P2, and when the cleaning rod 210 is not set to be in the contact position P2, it is possible to determine that the printing is permitted and to perform the printing mode, and on the other hand, when it is detected that the cleaning rod 210 is positioned in the contact position P2, it may be determined that the printing is prohibited and the cleaning mode Mc may be performed.

Notification Processing of Cleaning Time

Figure 11A:
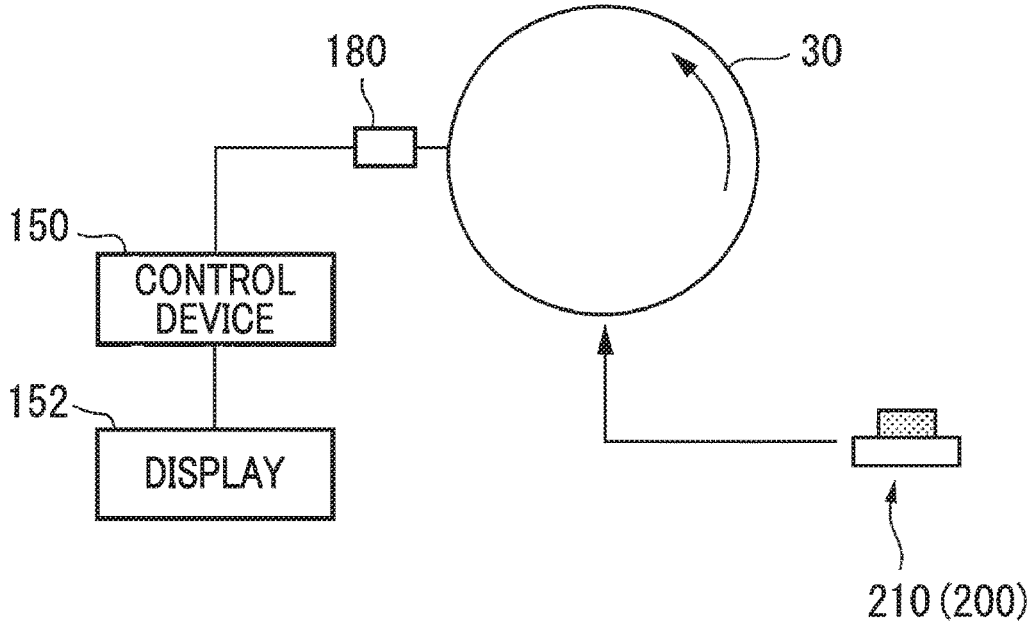
FIG. 11A is an explanatory view illustrating an example of a notification system for notifying a cleaning time by the second cleaning device.
Figure 11B:
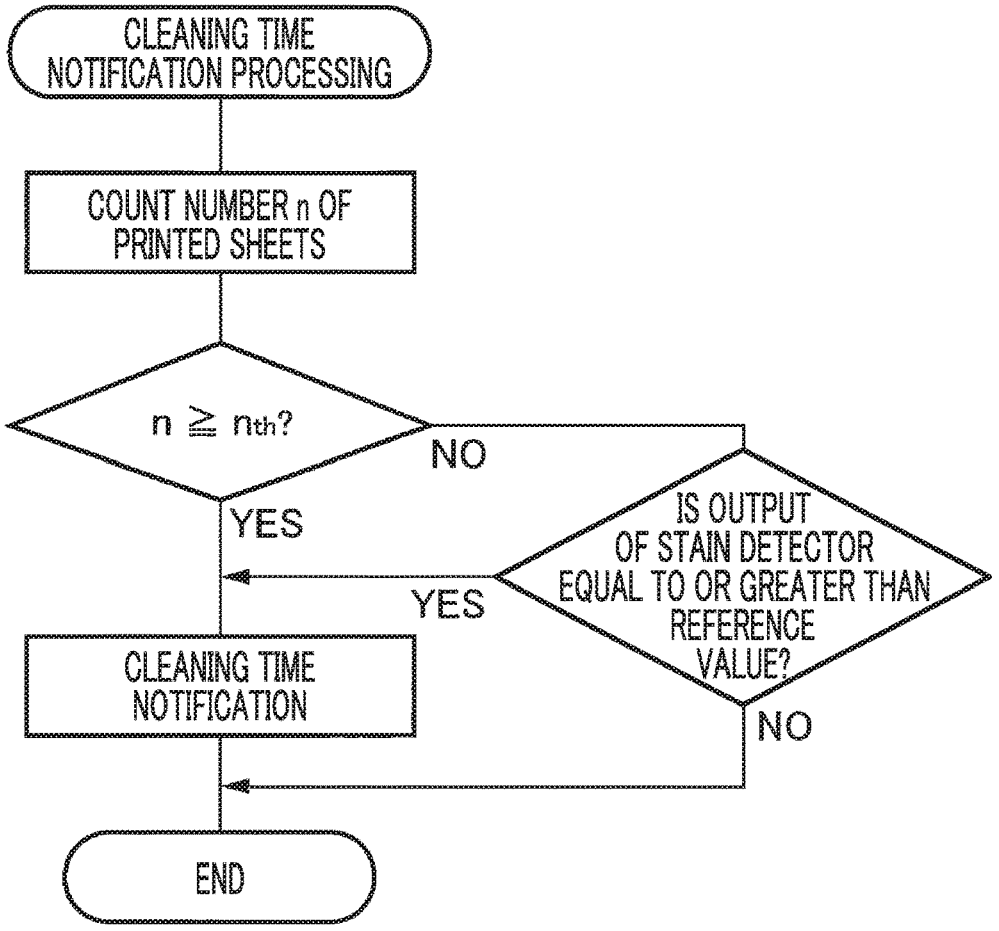
FIG. 11B is a flowchart illustrating cleaning time notification processing by the notification system illustrated in FIG. 11A.

Regarding the time of implementation of the cleaning device 200 for maintenance, the user may voluntarily perform the cleaning by the cleaning device 200 for maintenance as a result of the image quality defect being observed, but as illustrated in FIGS. 11A and 11B, it is also possible to construct a system for notifying that the cleaning time by the cleaning device 200 for maintenance can be grasped.

In the example, a stain detector 180 is provided to detect the filming state caused by the external additive on the surface of the photosensitive body 31, and when the stain detector 180 detects a stain equal to or greater than a predetermined threshold value, the control device 150 may notify a display 152 of the cleaning time of the cleaning device 200, or may periodically notify in consideration of the use history of the photosensitive body 31.

As the stain detector 180 described here, for example, an aspect in which the reflected light from the surface of the photosensitive body 31 is monitored at a wavelength having high sensitivity with respect to filming caused by the external additive, may be employed.

Therefore, as an example of a cleaning time notification processing system, as illustrated in FIG. 11B, the number n of printed sheets is counted, and when n reaches a predetermined threshold value $n_{th}$ or more, the time of the cleaning device 200 for maintenance is notified, and even when the number n of printed sheets does not reach the threshold value $n_{th}$, the cleaning time may be notified when the output of the stain detector 180 is equal to or greater than a reference value.

Layout of Cleaning Device for Maintenance

Figure 12A:
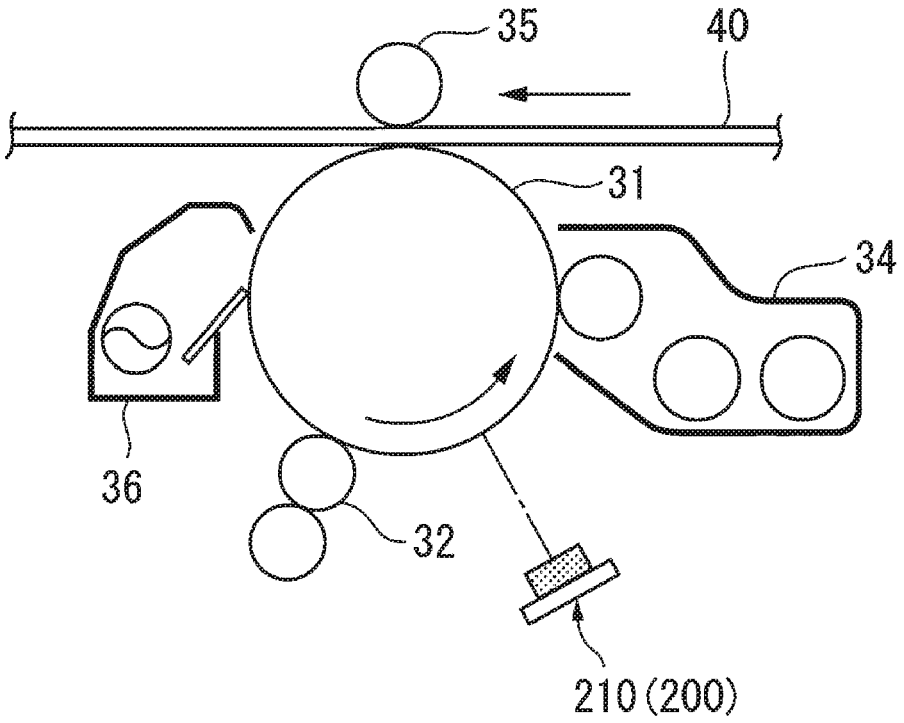
FIG. 12A is an explanatory view schematically illustrating an arrangement example of the second cleaning device according to the present exemplary embodiment.
Figure 12B:
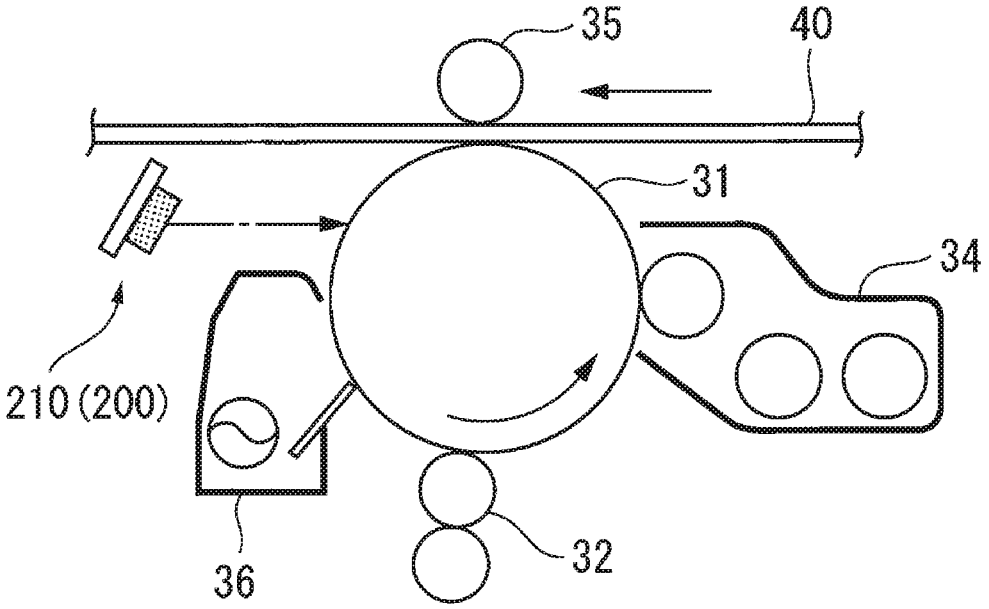
FIG. 12B is an explanatory view schematically illustrating an arrangement example of a second cleaning device of an image forming apparatus according to Modification Example 1.

In the exemplary embodiment, as illustrated in FIG. 12A, around the photosensitive body 31, the cleaning device 200 for maintenance is disposed downstream of the charging device 32 in the moving direction of the photosensitive body 31 and upstream of the developing device 34 in the moving direction of the photosensitive body 31, but not being limited thereto, and for example, as illustrated in FIG. 12B, the cleaning device 200 for maintenance may be disposed upstream of the regular cleaning device 36 in the moving direction of the photosensitive body 31 and downstream of the primary transfer device 35 in the moving direction of the photosensitive body 31.

In particular, in the layout illustrated in FIG. 12B, when performing the cleaning by the cleaning device 200 for maintenance, an external additive that could not be cleaned by the cleaning device 200 for maintenance is temporarily generated, without coming into contact with the intermediate transfer body 40, it is possible to perform the cleaning by the regular cleaning device 36, and accordingly, it is possible to further improve the cleanness of the photosensitive body 31.

Modification Example of Cleaning Device for Maintenance

As a method of disposing the cleaning rod 210 in the contact position P2 which is in contact with the surface of the photosensitive body 31, in the exemplary embodiment, the guide mechanism 230 adopts a method of disposing the cleaning rod 210 in the contact position P2 only by the operation of inserting and extracting the cleaning rod 210 along the axial direction of the photosensitive body 31, but not being limited thereto, for example, in addition to the insertion and extraction operation of the cleaning rod 210, a method in which the cleaning rod 210 can rotate around an axis parallel to the axial direction of the photosensitive body 31 after inserting the cleaning rod 210 and the cleaning rod 210 is rotated to come into contact with the peripheral surface of the photosensitive body 31, may be adapted.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A cleaning device comprising:

a cleaning tool that is movable along an intersecting direction intersecting with a moving direction of an image holding unit and cleans a surface of the image holding unit if the cleaning tool is placed in a contact position where the cleaning tool is in contact with the surface of the image holding unit; and a guide configured to guide the cleaning tool so that the cleaning tool moves from a non-contact position, where the cleaning tool is not in contact with the image holding unit, to the contact position for cleaning the surface of the image holding unit, wherein the cleaning device is configured such that, if the image holding unit is moved, the cleaning tool placed in the contact position cleans the surface of the image holding unit without moving.

2. The cleaning device according to claim 1, wherein the cleaning tool comprises:

a cleaning member that comes into contact with the surface of the image holding unit, and a support member configured to support the cleaning member, and wherein the support member comprises a grip portion configured for gripping by a user, and wherein the support member protrudes from a region of the cleaning member.

3. The cleaning device according to claim 2, wherein the cleaning member includes a material that is elastically deformable if placed in the contact position and brought into contact with the surface of the image holding unit.

4. The cleaning device according to claim 1, wherein the guide comprises a holding portion on which the cleaning tool is detachably held, wherein the holding portion is configured to guide the cleaning tool so that the cleaning tool can be inserted to and drawn from one end of the image holding unit in the intersecting direction, and wherein the holding portion is configured to hold the cleaning tool in the non-contact position during a period from an insertion start position in which the cleaning tool starts to face a peripheral surface of the image holding unit to immediately before the cleaning tool reaches an insertion completion position in which the cleaning tool is completely inserted to face the peripheral surface of the image holding unit and to hold the cleaning tool in the contact position at a stage if the cleaning tool reaches the insertion completion position.

5. The cleaning device according to claim 4, wherein the guide is configured to guide the cleaning tool to a step portion formed at a terminal end of the holding portion, and wherein the guide is configured to hold the cleaning tool in the contact position at the stage if the cleaning tool reaches the insertion completion position.

6. The cleaning device according to claim 4, wherein the guide is configured to allow the cleaning tool to be pulled out and kept in contact with the peripheral surface of the image holding unit if the cleaning tool is pulled out from the insertion completion position to the insertion start position.

7. An image forming apparatus comprising:

at least one image holding unit capable of holding an image formed using an image forming material;

a transfer unit configured to transfer the image held by the image holding unit to a transfer medium;

a first cleaning unit configured to remove a residue on the image holding unit;

a second cleaning unit configured to clean a surface of the image holding unit after cleaning by the first cleaning unit; and a notification unit configured to notify the second cleaning unit of a cleaning time, wherein the second cleaning unit comprises:

a cleaning tool that is movable along an intersecting direction intersecting with a moving direction of the image holding unit and cleans the surface of the image holding unit if the cleaning tool is placed in a contact position where the cleaning tool is in contact with the surface of the image holding unit; and a guide configured to guide the cleaning tool so that the cleaning tool moves from a non-contact position, where the cleaning tool is not in contact with the image holding unit, to the contact position for cleaning the surface of the image holding unit, wherein the image forming apparatus is configured such that, if the image holding unit is moved, the cleaning tool placed in the contact position cleans the surface of the image holding unit.

8. The image forming apparatus according to claim 7, further comprising:

a detection unit configured to detect a state of any deposit on the surface of the image holding unit, wherein the notification unit is configured to notify the cleaning unit of the cleaning time based on a result of detection by the detection unit.

9. An image forming apparatus comprising:

at least one image holding unit capable of holding an image formed using an image forming material;

a transfer unit configured to transfer the image held by the image holding unit to a transfer medium;

a first cleaning unit configured to remove a residue on the image holding unit;

a second cleaning unit configured to clean a surface of the image holding unit after cleaning by the first cleaning unit; and a notification unit configured to notify the second cleaning unit of a cleaning time, wherein the second cleaning unit comprises:

a cleaning tool that is movable along an intersecting direction intersecting with a moving direction of the image holding unit and cleans the surface of the image holding unit if the cleaning tool is placed in a contact position where the cleaning tool is in contact with the surface of the image holding unit;

a guide configured to guide the cleaning tool so that the cleaning tool moves from a non-contact position, where the cleaning tool is not in contact with the image holding unit, to the contact position for cleaning the surface of the image holding unit; and a position detection unit configured to determine whether or not the cleaning tool is placed in the contact position, wherein the cleaning tool is configured such that, if the position detection unit detects that the cleaning tool is placed in the contact position, the cleaning tool placed in the contact position cleans a moving surface of the image holding unit.

10. The image forming apparatus according claim 9, wherein the second cleaning unit includes a position detection unit configured to determine whether or not the cleaning tool is placed in the contact position, and wherein the image forming apparatus is configured such that regular image forming processing is performed if the position detection unit detects that the cleaning tool is not placed in the contact position.

* * * * *